US005692737A

United States Patent [19]

Perlsweig

[11] Patent Number: 5,692,737

[45] Date of Patent: Dec. 2, 1997

[54] HELICAL SPRING AMUSEMENT DEVICE AND STRESS RELIEVER

[76] Inventor: Leon Perlsweig, 6300 Wilshire Blvd.—#1630, Los Angeles, Calif. 90048

[21] Appl. No.: 666,875

[22] Filed: Jun. 25, 1996

[51] Int. Cl.[6] ..... A63H 33/00

[52] U.S. Cl. ..... 267/168; 267/179; 446/170; 446/431; 446/486

[58] Field of Search ..... 267/168, 170, 267/166, 167, 70, 73, 289, 290, 166.1, 4, 203, 204, 212, 213, 91, 275, 285, 154, 179; 446/486, 170, 431

[56] References Cited

U.S. PATENT DOCUMENTS

| | | | |
|---|---|---|---|
| 158,361 | 1/1875 | Clooney | 267/290 |
| 505,092 | 9/1893 | Chatillon . | |
| 1,170,146 | 2/1916 | Gallagher, Jr. | 267/168 |
| 2,086,321 | 7/1937 | Kudo | 267/290 |
| 2,415,012 | 1/1947 | James . | |
| 2,854,786 | 10/1958 | Sabo . | |
| 3,005,286 | 10/1961 | Derham . | |
| 3,011,775 | 12/1961 | MacLeod | 267/167 |
| 3,047,980 | 8/1962 | Bischoff . | |
| 3,169,757 | 2/1965 | Roder et al. | 267/170 |
| 3,531,069 | 9/1970 | Dubberley | 267/168 |
| 3,559,976 | 2/1971 | Jerz, Jr. | 267/290 |
| 3,563,526 | 2/1971 | Mui | 267/179 |
| 3,618,214 | 11/1971 | Armstrong | 267/168 |
| 3,649,000 | 3/1972 | Desy | 267/179 |
| 4,114,306 | 9/1978 | Molenaar . | |
| 4,162,064 | 7/1979 | Bouton et al. | 267/170 |
| 4,348,016 | 9/1982 | Milly | 267/177 |
| 4,475,725 | 10/1984 | Niemann | 267/179 |
| 4,728,087 | 3/1988 | Wils | 267/179 |
| 4,962,834 | 10/1990 | Miher | 267/179 |
| 5,165,421 | 11/1992 | Fleischhaker et al. | 267/168 |
| 5,178,576 | 1/1993 | Ayers . | |
| 5,470,049 | 11/1995 | Wohler et al. | 267/170 |

FOREIGN PATENT DOCUMENTS

| | | | |
|---|---|---|---|
| 385821 | 3/1908 | France | 446/486 |
| 688708 | 8/1930 | France | 267/290 |
| 1391845 | 1/1964 | France | 267/179 |
| 1048096 | 12/1958 | Germany | 267/290 |
| 487108 | 6/1955 | Italy | 267/204 |
| 326944 | 3/1930 | United Kingdom | 267/290 |
| 9212358 | 7/1992 | WIPO | 267/168 |

*Primary Examiner*—Douglas C. Butler
*Attorney, Agent, or Firm*—Brumbaugh, Graves, Donohue & Raymond

[57] ABSTRACT

A helical spring device used for amusement or for stress relief having a plurality of concentrically positioned helical coil springs each extending between two endpieces. The helical coil springs each are highly flexible with a low spring stiffness to mass ratio, and each have a different diameter. The endpieces have an internal member and an external member, with the internal piece having a slit extending through it. The ends of the helical coil springs are inserted through the slits in the internal members in such a manner that they are positioned between the internal and external members. The ends are secured in place by a fastener such as a screw which extends between the internal and external members.

9 Claims, 3 Drawing Sheets

HELICAL SPRING AMUSEMENT DEVICE AND STRESS RELIEVER

BACKGROUND OF THE INVENTION

This invention relates to a helical spring device which is used for amusement and stress relief, and more particularly to a device having multiple concentrically positioned flexible helical coil springs, each having a different diameter and extending between two endpieces.

The use of a helical spring as a toy or amusement device is well known, and has been widely commercialized under the trademark "Slinky". U.S. Pat. No. 2,415,012 to James, discloses a flexible helical spring toy which is capable of moving by itself down stairs or an inclined plane once the toy is set in motion. The device has a low ratio of spring stiffness to mass, which results in a low natural frequency. The coils of the spring are rectangular in cross-section, and in the upright resting position, successive coils rest on one another. The ends of the helical spring, however, are unprotected, and are thus subject to bending or distortion. Furthermore, the unprotected spring ends are difficult to grasp, rendering the device less suitable for manipulation by hand. Moreover, when grasped in the hands, a number of coils at each end remain collapsed, thereby shortening the extendable length of the spring.

Other prior art amusement devices incorporate a flexible helical spring of the type disclosed in James, with the ends secured to solid base members. U.S. Pat. No. 2,854,786 to Sabo discloses a flexible helical spring secured at each end to a rectangular or disk shaped base member by several clips. The base members, however, are either securely fastened to a stand, or have knobs affixed to them such that the device cannot "walk" down stairs or an inclined plane, and cannot stand on either or both ends on its own.

U.S. Pat. No. 3,047,980 to Bischoff discloses an amusement device including a small playing piece consisting of a coil spring connected at each end to an eccentrically weighted, flat annular disk-like member. The eccentrically weighted ends in conjunction with the tilting of the playing board cause the playing piece to move end over end in an unpredictable step-like fashion along the playing board. The playing piece is used in conjunction with the playing board, and is not suitable for manipulation by hand or use independent of the playing board.

SUMMARY OF THE INVENTION

It is an object of the present invention to provide a helical spring device for use for amusement and stress reduction, which has a plurality of concentrically positioned helical coil springs each of a different diameter.

It is another object of the present invention to provide a helical spring device of the above described type in which the plurality of concentrically positioned helical coil springs cause the device to have a heavier feel when manipulated by hand.

It is another object of the present invention to provide a helical spring device of the above described type, the ends of which are protected by endpieces.

It is a further object of the present invention to provide a helical spring device of the above described type which is capable of "walking" down stairs or an inclined plane once set in motion.

It is yet another object of the present invention to provide a helical spring device of the above described type which may, in a resting position, be used to hold letters, notes, pencils or other small objects.

In accordance with these objectives, a multipurpose helical spring device includes a plurality of helical coil springs of different diameters, positioned concentrically relative to each other, each having a first and second end and a plurality of coils. The first and second ends of each of the helical coil springs are respectively secured to a first and a second endpiece, adapted to be comfortably held in the hand. The endpieces are formed of a pair of planar members between which the spring ends are secured. Each of the springs is highly flexible and has a low spring stiffness to mass ratio so that when the device is resting entirely on one endpiece, the coils rest on one another.

In a preferred embodiment, each of the endpieces is substantially circular in shape, is larger in diameter than the largest of the helical coil springs, and is comprised of internal and external disks releasably fastened together. The respective ends of the plurality of springs are inserted through openings in the internal disks of the first and second endpieces such that when the internal and external disks of the respective endpieces are fastened together, such as by a screw, the ends of the springs are firmly secured between the disks.

BRIEF DESCRIPTION OF THE DRAWINGS

Further objects, features and advantages of the invention will become apparent from the following detailed description taken in conjunction with the accompanying figures in which.

Figure 1:
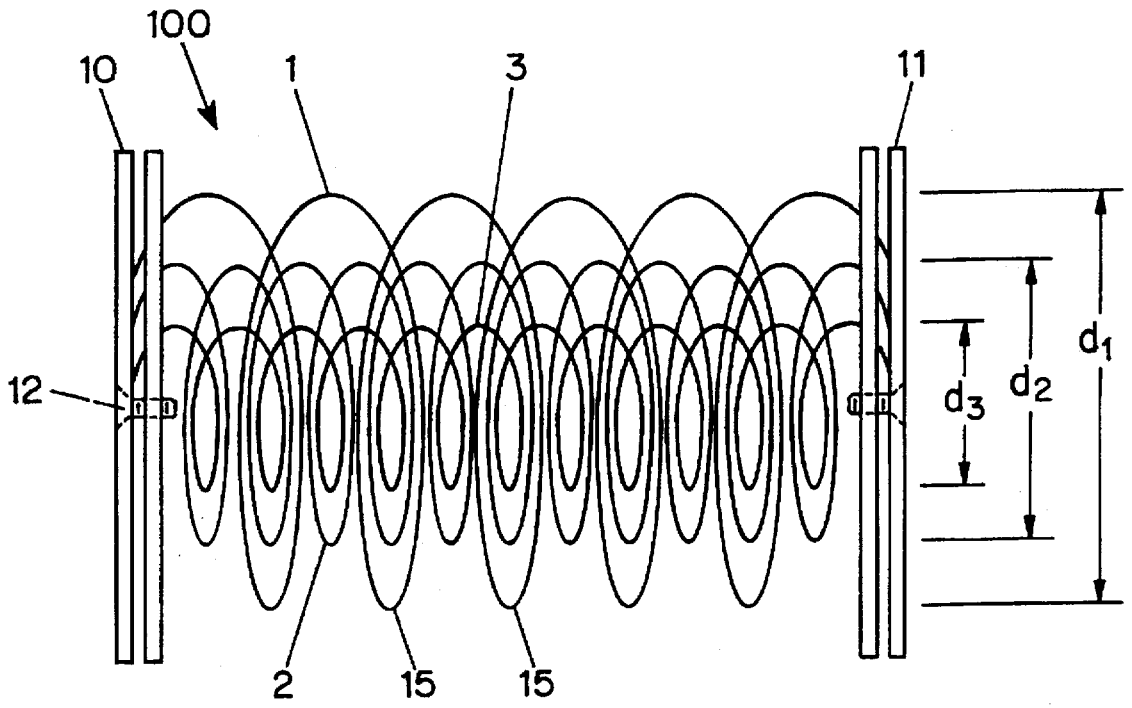
FIG. 1 is side view of a multipurpose helical spring device in accordance with the invention resting horizontally on the edges of the endpieces.

Throughout the figures, the same reference numerals, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

FIG. 1 illustrates a preferred embodiment of the helical spring device 100, having three helical coil springs 1, 2, and 3, each secured at a first end to a first endpiece 10, and at a second end to a second endpiece 11. The helical coil springs each have a different diameter $d_1$, $d_2$, $d_3$ and a plurality of individual coils 15, and are positioned concentrically relative to each other. It is apparent that two, or more than three helical coils springs may be used without departing from the spirit of the invention.

Figure 2:
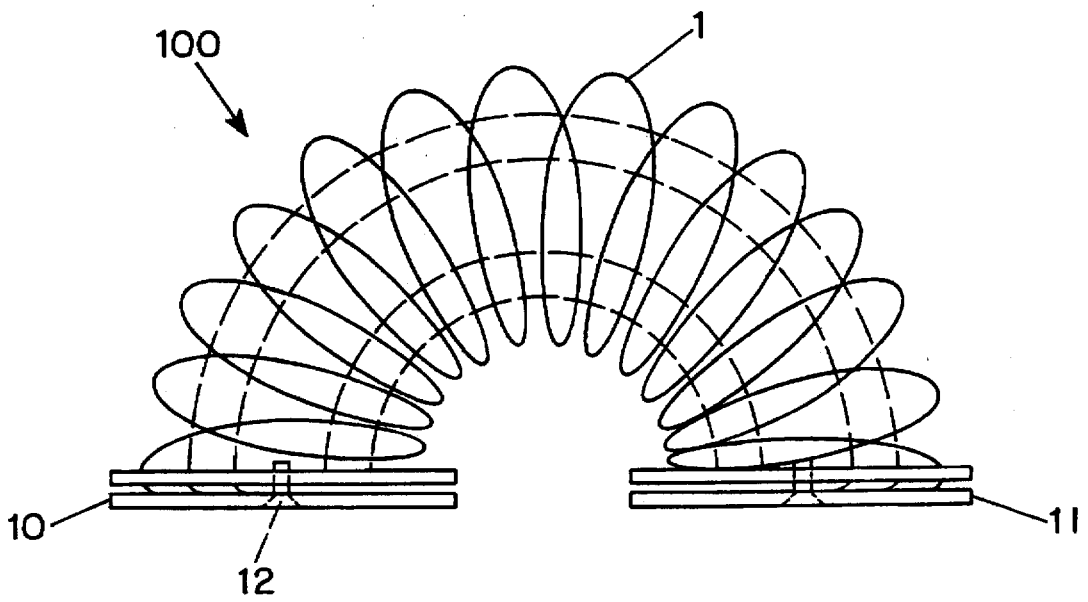
FIG. 2 is a side view of a multipurpose helical spring device in accordance with the invention which is positioned so that it is resting on the flat surfaces of both endpieces.

In FIG. 2, the helical spring device 100 is shown positioned so that it rests on both endpieces 10, 11 at the same time, with the three helical coils springs forming a semicircular arc which extends between the endpieces. For the sake of clarity, FIG. 2 shows only one helical coil spring 1, in full, with the outer diameters of springs 2 and 3 shown in dotted lines.

Figure 3:
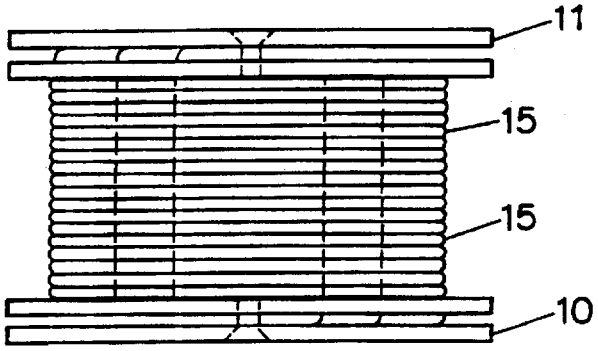
FIG. 3 is a side view of a multipurpose helical spring device in accordance with the invention which is resting entirely on one endpiece.

Each individual helical coil spring 1, 2, 3 possesses the physical properties and characteristics commonly associated with the single spring toys of the well-known type. Such springs are resilient and highly flexible, and have a low spring stiffness to mass ratio so that when the device is resting entirely on one endpiece, e.g., 10, as shown in FIG. 3, the plurality of coils 15 of each spring are resting on one another. These properties also enable the multi-spring device of the invention to "walk" end-over-end, down stairs or an inclined plane in a manner similar to a "Slinky". The springs may be made of any suitable metal or plastic having the requisite properties.

Figure 4:
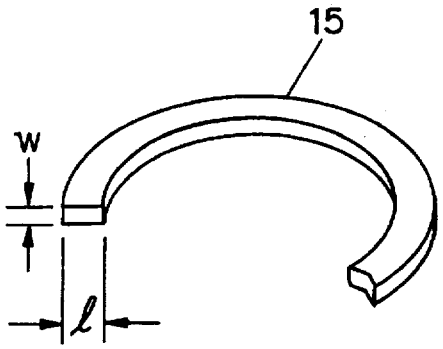
FIG. 4 is a cross-section of a portion of a coil of a helical coil spring.

The individual coils 15 of each helical coil spring preferably are substantially rectangular in cross-section, as shown in FIG. 4. Alternatively, the coils 15 may have circular or oval cross-sections.

Figure 5:
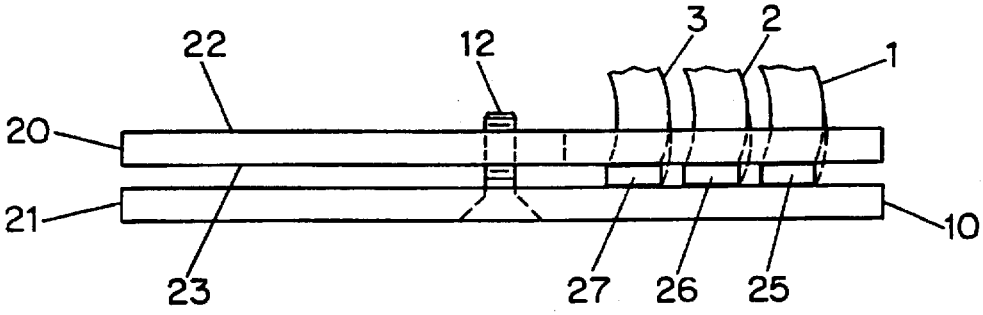
FIG. 5 is a side view of an endpiece of the helical spring device in accordance with the invention.
Figure 6:
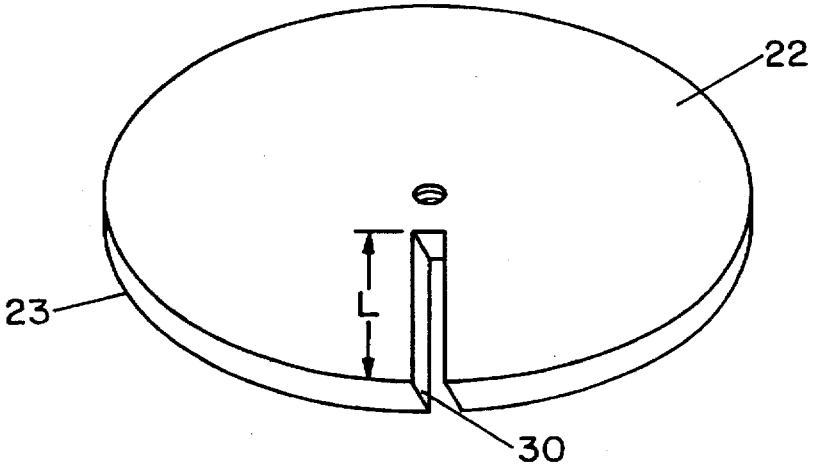
FIG. 6 is a perspective view of a preferred embodiment of the internal disk of an endpiece of the helical spring device.

FIG. 5 illustrates how first ends 25, 26, 27 of each of the helical coil springs 1, 2, 3 are secured to a first endpiece 10. Each endpiece 10, 11 has an internal disk-shaped member 20 and an external disk-shaped member 21, both disks being of the same diameter. Although circular disks are illustrated, the members may be of any shape suitable for holding comfortably in the hand. In a preferred embodiment, the internal disk 20 has a single slit 30, as shown in FIG. 6, which extends at an angle between the first 22 and second 23 surfaces of the internal disk 20. The slit extends to the outer perimeter 31, and has a length L sufficient to accommodate the ends 25, 26, 27 of the three helical coil springs.

Referring again to FIG. 5, ends 25, 26, 27 of the helical coil springs 1, 2, 3 are inserted through the slit 30 in the internal disk 20 so that each end extends beyond the slit and is positioned between the underside 23 of the internal disk 20 and the external disk 21. Once the spring ends are positioned, a screw or other similar fastening means 12 is inserted and tightened so that the disks 20 and 21 are pressed towards one another, thereby firmly securing the end of each of the helical coil springs 1, 2 and 3 in place. The opposite ends of the helical coil springs are secured to the second endpiece in the same fashion.

Preferably, the endpieces are fabricated out of plastic, such as acrylic, but wood or other rigid sheet material may be used.

Figure 7A:
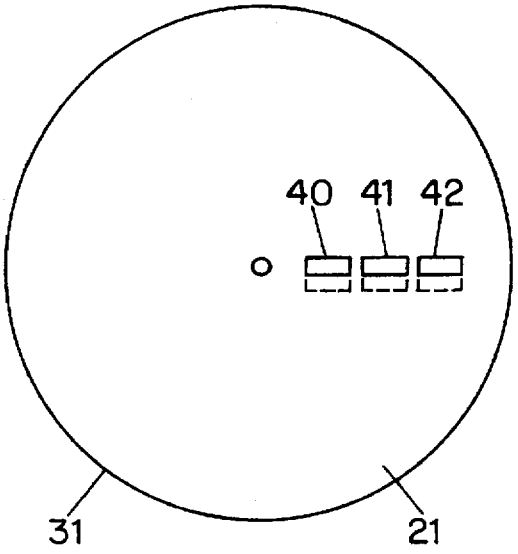
FIG. 7A is a top view of an alternate embodiment of the internal disk of an endpiece of the helical spring device.
Figure 7B:
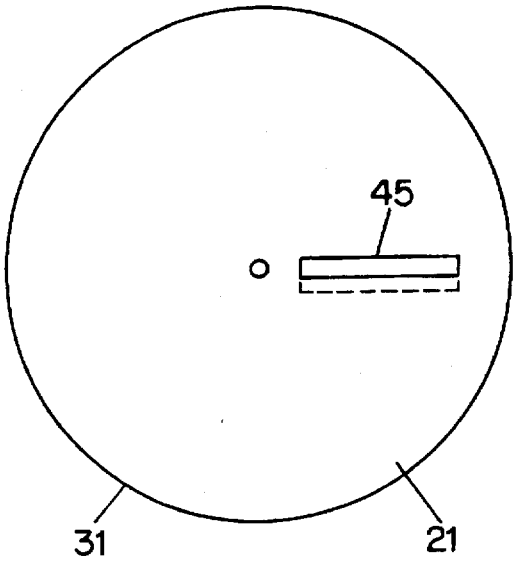
FIG. 7B is a top view of another embodiment of the internal disk of an endpiece of the helical spring device.

Although FIG. 6 illustrates a single slit which extends to the outer perimeter 31 of the internal piece 20, multiple slits 40, 41, 42, one for each helical coil spring can be used, as shown in FIG. 7A, or, alternatively, as illustrated in FIG. 7B, a single slit 45 which does not extend to the outer perimeter of the internal disk 20 is also suitable.

Figure 8:
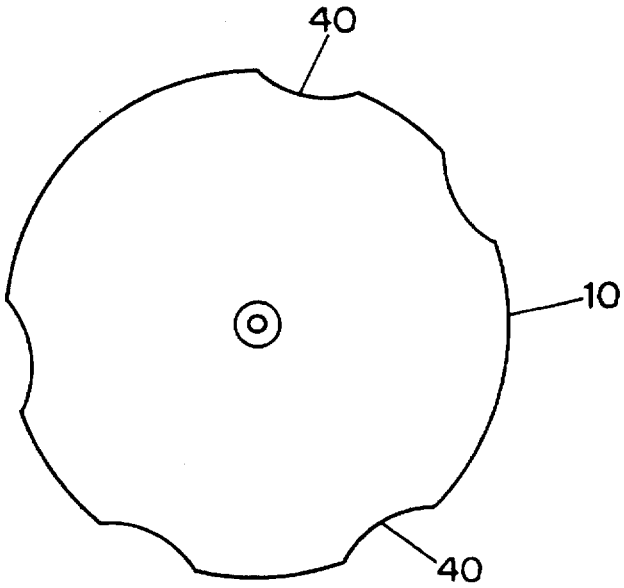
FIG. 8 is a perspective view of the outer disk of the endpiece.

In a preferred embodiment, the endpieces 10, 11 each have a plurality of indentations 40 spaced around the perimeter, as shown in FIG. 8, to receive the fingers of the hand. The indentations 40 provide a more comfortable feel to the device, making it more pleasurable for manipulation by hand. Other configurations of the periphery of the endpiece to facilitate handling, may be used.

The helical spring device of the invention, with multiple concentrically positioned helical coil springs secured at each end to an endpiece, provides a sturdy device for amusement purposes. With the ends of the springs secured between the disks of the endpieces, they are protected from damage and their sharp ends are shielded. When manipulated by a user, the device provides a soothing feeling and a pleasurable sound, making it effective as a stress reliever. In addition, the multiple helical coils give the device a unique, heavier feel which enhances its soothing effects.

Other modifications of the invention will be obvious to those skilled in the art, and it is intended that the scope of the invention be limited only as set forth in the appended claims.

I claim:

1. A multipurpose helical spring amusement device comprising:

(a) a plurality of concentrically arranged helical coil springs of respectively different diameters, each having a plurality of coils and a first and second end, each of said springs being highly flexible with a low spring to mass ratio, and (b) first and second endpieces, adapted to be manually grasped, said first ends of said plurality of helical coil springs being secured to said first endpiece, and said second ends of said plurality of helical coil springs being secured to said second endpieces, each of said endpieces having a flat outer surface substantially perpendicular to the axis of said helical coil springs, (c) the flexibility and stiffness to mass ratio of said helical coil springs being such that when the flat outer surface of one of said endpieces is resting on a horizontal surface with the axis of said springs extending vertically and said springs in a fully relaxed condition, all of the individual coils of the outermost of said springs rest on one another.

2. A device according to claim 1, wherein each of said first and second endpieces further comprise an internal and an external member.

3. A device according to claim 2, each of said internal members having at least one slit extending between a first and second surface of said internal member.

4. A device according to claim 3, said first end of each of said plurality of helical coil springs being inserted through said at least one slit in said internal member of said first endpiece so that a portion of each of said first ends is positioned between said internal member and said external member of said first endpiece, and said second end of each of said plurality of helical coil springs being inserted through said at least one slit in said internal member of said second endpiece so that a portion of each of said second ends is positioned between said internal member and said external member of said second endpiece.

5. A device according to claim 4, further comprising releasable fastening means for securing the internal and external members of each endpiece to each other with the respective ends of said plurality of helical coil springs inserted therebetween.

6. A device according to claim 1, wherein said first and second endpieces are substantially circular in shape, and have a diameter larger than the diameter of the outermost helical coil spring of said plurality.

7. A device according to claim 1, wherein said first and second endpieces are made of an acrylic material.

8. A device according to claim 1, wherein said first and second endpieces are provided with a plurality of indentations spaced around their perimeters to engage the fingers of the user.

9. A device according to claim 1, wherein the cross-sections of the coils of each of said plurality of helical coil springs are substantially rectangular.

* * * * *